United States Patent [19]

Larsen

[11] Patent Number: 5,025,757

[45] Date of Patent: Jun. 25, 1991

[54] RECIPROCATING PISTON ENGINE WITH A VARYING COMPRESSION RATIO

[76] Inventor: Gregory J. Larsen, 4501 Hallam Hill La., Lakeland, Fla. 33813

[21] Appl. No.: 582,410

[22] Filed: Sep. 13, 1990

[51] Int. Cl.[5] ..... F02B 75/04

[52] U.S. Cl. ..... 123/48 R; 123/78 R

[58] Field of Search ..... 123/48 R, 78 R

[56] References Cited

U.S. PATENT DOCUMENTS

| | | | |
|---|---|---|---|
| 1,343,536 | 6/1920 | Weeks | 123/48 R |
| 3,868,931 | 3/1975 | Dutry et al. | 123/78 R |
| 4,419,969 | 12/1983 | Bundrick | 123/48 R |
| 4,876,992 | 10/1989 | Sobotowski | 123/48 R |

FOREIGN PATENT DOCUMENTS

| | | | |
|---|---|---|---|
| 60-22030 | 2/1985 | Japan | 123/78 R |

*Primary Examiner*—David A. Okonsky

*Attorney, Agent, or Firm*—Brumbaugh, Graves, Donohue & Raymond

[57] ABSTRACT

A reciprocating piston internal combustion engine with a varying compression ratio comprises a block having at least one piston bore, a piston received in each bore, a head attached to the block and having a dome portion closing the top of each bore and defining with the piston a compression volume when the piston is at top dead center in the bore, a crankcase, a crank rotatably mounted in the crankcase, and a connecting rod coupling each piston to the crank. The block is mounted on the crankcase for pivotal movement about a pivot axis parallel to and spaced apart from the axis of the crank such that the size of the compression volume varies in accordance with the extent of the pivotal movement of the block about the pivot axis. An actuator connected between the block and the crankcase pivots the block about the pivot axis relative to the crankcase in response to at least one signal indicative of at least one operating parameter of the engine.

9 Claims, 10 Drawing Sheets

PISTON STROKES: (1) INTAKE
(2) COMPRESSION
(3) WORK
(4) EXHAUST

THEORETICAL FOUR-STROKE CYCLE $$P_1 V_1^n = P_2 V_2^n$$

$$\text{AREA } P_1P_2V_2V_1 = \int_{V_1}^{V_2} P\,dV$$

$$A = \frac{1}{n=1}(P_1V_1 - P_2V_2)$$

RECIPROCATING PISTON ENGINE WITH A VARYING COMPRESSION RATIO

BACKGROUND OF THE INVENTION

In an engine operating on a four-stroke cycle (FIG. 1), a mixture of fuel and air, trapped above a moving piston in a closed cylinder, is, during the second and third strokes (FIG. 2), subjected to changes in temperature, volume and pressure, whereby the chemical energy of the fuel is partly converted into mechanical energy of the output shaft.

Thermodynamic analysis of the process shows that for maximum conversion efficiency, the combustion of the mixture must take place in the smallest possible volume with the minimum surface area and at the highest possible temperature. This means that the mixture must be compressed prior to the ignition.

In a practical engine the compression is limited by the onset of detonation, a too rapid combustion which can lead to internal damage of the engine, whereas too high a combustion temperature will cause the percentage of nitrous oxides ($NO_x$) in the exhaust gases to exceed governmentally established limits on exhaust emissions. Within these constraints, the volume and shape of the combustion chamber are selected to provide optimal combustion conditions for the maximum cylinder charge.

During the first stroke (intake stroke, FIG. 2), the downward moving piston creates a lower-than-atmospheric pressure which causes the fuel/air mixture to flow into the cylinder. This gas flow possesses kinetic energy and, as a result, it continues for a short time after the piston reaches BDC. The velocity of the gas flow, as well as the pressure difference that drives it, vary approximately as the square of the engine speed, and the conditions which result in the maximum charge entering the cylinder can, therefore, only prevail at one particular engine speed.

When the engine is developing its maximum torque at speeds higher or lower than that which results in the maximum charge, the cylinder charge is less than maximum, and the volume of the combustion chamber is "too large" for optimal combustion conditions to occur. This discrepancy becomes even more pronounced when the engine operates at part load.

The power output of a spark-ignited (SI) engine can be controlled by varying either the density (throttle valve in inlet duct) or the volume (late or early closing of the intake valve) of the mixture at the beginning of the compression stroke (LIVC, EIVC).

Obviously, compressing less than the maximum mass in the fixed-volume combustion chamber will generate pressures and temperatures that are lower than those reached under maximum output conditions, and the resulting drop in energy conversion efficiency is the main reason for the low thermal efficiency of spark-ignited engines at part load. In order to deliver power with greater efficiency throughout the output range, an engine, therefore, must incorporate a means for varying the volume of the combustion chamber (commonly described as a variable compression ratio or VCR) in proportion to the load and, to a lesser extent, to the speed.

The compression ratio (C/R), which is defined as the ratio between the volumes above the piston at BDC and TDC (see FIG. 1), is no indication of the efficiency of the combustion process, since the condition of the mixture, just prior to the ignition, depends on the closing time of the intake valve, the engine speed and the initial temperature and density at the beginning of the compression stroke.

The effect of VCR on the part-load operation of an IC engine can best be illustrated by a numerical example. FIGS. 3A, 3B and 3C of the drawings show the PV diagrams of an ideal Otto cycle engine under different operating conditions:

FIG. 3A—Knock-limited, max. load

FIG. 3B—Conventional, part load, standard C/R

FIG. 3C—Knock-limited, part load, increased C/R

In the example, the derived values of volume and pressure are based on the following assumptions:

| | |
|---|---|
| Exponent of (polytropic) compression and expansion lines, | n = 1.3 |
| Compression ratio, standard engine | C/R = 6 |
| Knock-limited combustion pressure | P = 600 psia |
| Ratio of pressure multiplication after combustion | a = 4 |

In FIG. 3A:

$$P_2 = P_3/4 = 600/4 = 150 \text{ psia}$$

$$P_1 = P_2(V_C/V_T)^{1.3} = 150(1/6)^{1.3} = 14.60 \textit{ psia}$$

$$P_4 = 4P_1 = 4(14.60) = 58.42 \textit{ psia}$$

For part load operation, as shown in FIG. 3B, the condition is chosen whereby the cylinder pressure during the compression stroke reaches 14.60 psia when the volume above the piston is $(V_C+V_D)/2 = V_T/2$. Under these conditions, the mass of the mixture trapped in the engine cylinder is 50% of the maximum charge.

$$P_5 = 14.60 \text{ psia}$$

$$P_6 = (V_T/2V_C)^{1.3}P_5 = 3^{1.3}(14.60) = 60.92 \textit{ psia}$$

$$P_7 = 4P_6 = 4(60.92) = 243.68 \textit{ psia}$$

$$P_8 = P_7(V_C/V_T)^{1.3} = 243.68(1/6)^{1.3} = 23.73 \textit{ psia}$$

$$P_9 = P_8/4 = 23.73/4 = 5.93 \textit{ psia}$$

In FIG. 3C, while keeping the volume of the mixture $V_T/2$ the same as in FIG. 3B, and $P_{11} = P_5 = 14.60$ psia, the compression space is reduced to $V_X$ in order to attain the knock-limited end-compression pressure $P_{12} = 150$ psia.

$$P_{12}/P_{11} = P_2/P_1 = 150/14.60$$

$$(V_T/2V_X)^{1.3} = (V_T/V_C)^{1.3} = 150/14.60$$

$$V_X = V_C/2$$

$$C/R = V_T/V_C = (V_D+V_C)/V_C = V_D/V_C + V_C/V_C = 6$$

$$V_D/V_C = 6-1 = 5$$

$$C/R' = V_T'/V_X = (V_D V_X)/V_X = 2V_D/V_C + V_X/V_X = 11$$

$$P_{13} = 4P_{12} = 4(150) = 600 \textit{ psia}$$

$$P_{14} = (V_X/V_T')^{1.3}(600) = (1/11)^{1.3}(600) = 26.57 \text{ psia}$$

$$P_{15} = P_{14}/4 = 26.57/4 = 6.64 \textit{ psia}$$

The ideal cycle diagrams presented in FIGS. 3A, 3B and 3C provide a crude approximation to a real engine operating cycle, but since the same simplifications are used in all cases, a comparison of the area enclosed by each diagram (which is proportional to the work done by the gases on the piston) can give an indication of the beneficial effect of VCR under part-load conditions. The area of the diagram represents work produced when the engine is surrounded by a vacuum; in FIGS. 3B and 3C the compression lines drop below the "atmospheric" line of 14.60 psia and the areas enclosed by points $P_5$, $P_9$, $P_{17}$, and $P_{11}$, $P_{15}$, $P_{16}$, thus represent negative work that results when the motion of the piston is in the opposite direction of the gas pressure acting upon it. Therefore, to determine the area of the diagram representing the net engine output, twice the area enclosed by the negative loop must be subtracted from the calculated values (see FIG. 3D).

In FIG. 3A:

$$\text{AREA}(P_1P_2P_3P_4P_1) = \text{AREA}(V_CP_3P_4V_T) - \text{AREA}(V_CP_2P_1V_T)$$
$$A_1 = (P_3V_C - P_4V_T - P_2V_C + P_1V_T)/(n-1)$$
$$= \{(P_3 - P_2)V_c - (P_2 - P_1)V_T\}/n - 1$$
$$A_1 = \{(600 - 150)(1) - (58.42 - 14.60)(6)\}/(1.3 - 1)$$
$$A_1 = 624$$

In FIG. 3B:

$$\text{AREA}(P_5P_6P_7P_8P_{17}P_5) = \text{AREA}(P_5P_6P_7P_8P_9P_5) - 2[\text{AREA}(P_5P_{17}P_9P_5]$$
$$A_2 = \{(P_7 - P_6)V_C - (P_8 - P_9)V_T\}/(n-1) - 2[14.60(V_T - V_T/2) - \{P_5(V_T/2) - P_9(V_T)\}/(n-1)]$$
$$A_2 = \{(243.68 - 60.92)(1) - (23.73 - 5.93)(6)\}/(1.3 - 1) - 2[14.60(6 - 3) - \{14.60(3) - 5.93(6)\}/(1.3 - 1)]$$
$$A_2 = 220.40$$

In FIG. 3C $$\text{AREA}(P_{11}P_{12}P_{13}P_{14}P_{16}P_{11}) = \text{AREA}(P_{11}P_{12}P_{13}P_{14}P_{15}P_{11}) - 2\{\text{AREA}(P_{11}P_{15}P_{16}P_{11})\}$$
$$A_3 = \{(P_{13} - P_{12})V_X - (P_{14} - P_{15})V_T'\}/(n-1) - 2[14.60(V_T^1 - V_T/2) - \{P_{11}(V_T/2) - P_{15}(V_T')\}/(n-1)]$$
$$A_3 = \{(600 - 150)(.5) - (26.57 - 6.64)(5.5)\}/(1.3 - 1) - 2[14.60(5.5 - 3) - \{14.60(3) - (6.64 \times 5.5)\}/(1.3 - 1)$$
$$A_3 = 360.33$$

Assigning 100% to the value of the work performed by an engine at maximum ($=A_1$), and taking into consideration that the mass of mixture converted at part-load is 50% of the maximum charge, the relative conversion efficiency is:

*Part-load, standard,*
$2A_2/A_1 = 2(220.40/624) \times 100\% = 70.6\%$

*Part-load, w/VCR,*
$2A_3/A_1 = 2(360.33)/624 \times 100\% = 115.5\%$

These results confirm the known fact that in a conventional Otto-cycle engine, at part load, the thermal efficiency is less than at maximum load and show not only the improvement in efficiency resulting from VCR but also that with VCR, the part-load efficiency is higher than the full-load efficiency in a conventional engine.

The explanation lies in the increase of the expansion and compression ratios, following the incorporation of VCR. The relationship between efficiency and C/R is expressed by the formula, $e = 1 - 1/C/R)^{k-1}$, derived from the air-standard cycle, a simplified simulation of an engine, used in thermodynamic analysis. Although the working medium is air only, which is subjected to adiabatic instead of polytropic processes, the results have proven to be reliable indicators of the relative effect of principal variables, such as C/R. The symbol k which for air has the value 1.4, represents the ratio of the specific heat at constant pressure $c_p$ to the specific heat at constant volume $c_v$.

Known mechanisms for varying the compression ratio

The formula $C/R = (V_C + V_D)/V_C$ shows that the compression ratio can be varied by changing $V_C$ or $V_D$, or both. Since varying the cylinder bore is not practical, all designs which vary the cylinder displacement $V_D$ involve some way of varying the engine stroke. No variable displacement engine has been commercially successful, however, and since the proposed invention involves varying the clearance volume $V_C$ only, a discussion of known mechanisms will be limited to this type of construction, which can be divided into two groups: (a) adjustable cylinder head or part hereof; and (b) adjustable piston crown.

The Cooperative Fuel Research (CFR) single-cylinder engine, built by Waukesha, is of the adjustable cylinder head type and is widely used in laboratories to determine the octane and cetane numbers of fuels. The cylinder head, complete with valves and cylinder wall, is adjustable by means of hand-cranked screwjacks even while the engine is running. In order to cope with the piston-induced side loads, the telescoping upper part of the engine must be guided accurately and virtually without backlash, which leads to a heavy and expensive construction. Strictly a research tool, this design is not practical for multi-cylinder engines.

As a starting aid for compression-ignited (CI) or diesel engines, the two-piece combustion chamber, of which a section can be closed off to temporarily increase the C/R, has been in use for many years. Examples of such arrangements are found in SAE Paper No. 870610, W. H. Adams et al., Luria U.S. Pat. No. 4,033,304 and Luria U.S. Pat. No. 4,084,557. In a newer development, the combustion space is equipped with a cylindrical extension carrying a piston which is adjustable from the outside.

A number of problems are associated with this construction:

(a) the C/R is adjustable over only over a small range;

(b) the combustion chamber has an unfavorable volume/surface ratio, which causes higher heat losses and thus a drop in thermal efficiency;

(c) when the movable piston must be cooled to prevent the creation of a hot spot in the wall of the combustion chamber, reliable sealing in the available space becomes difficult.

A two-piece piston developed by the British International Combustion Engine Research Association (BICERA), consists of an inner core, attached to the connecting rod in the usual manner, and an outer shell which is forced upward by engine oil under pressure and inertia forces when the piston approaches TDC, thus reducing the clearance volume $V_C$. Built-in flow restrictors control the rate of collapse when the high-pressure gases act on the top of the shell at the beginning of the work-stroke, thereby limiting the maximum combustion pressure over a wide range of operating conditions. These pistons have been successfully tried in medium size diesel engines, but in spark-ignited (SI) passenger car engines, the higher cost would be a problem. The increased inertia loads resulting from their weights could require a major bearing redesign.

The piston action is fully automatic and fast but responds to combustion pressures only. Additional factors, their inputs coordinated by a computer, could be used to optimize the C/R of an SI engine. However, the present construction does not enable these refinements.

Engines with either eccentric piston pins or telescoping connecting rods have been proposed. The main problem with these is that they require a highly-loaded mechanism for which very limited space, inside the piston or within the diameter of the connecting rod, is available. It is possible that a satisfactory construction will be found, suitable for very large units (24" bore minimum), but effects of scale seem to preclude a solution in the case of passenger car engines with pistons typically less than 4" piston diameter.

By mounting the main bearings in eccentric housings, the complete assembly of piston, connecting rod and crankshaft can be moved with respect to the cylinder head. Although space constraints in this case are less severe than those in engines of the type described in the preceding paragraph, maintaining perfect bearing alignment while making $V_C$ adjustments requires an extremely rigid, backlash-free design which is difficult to achieve, especially in multi-cylinder engines. Moreover, the connection between the crankshaft and the engine output shaft, as well as auxiliary drives requires Oldham couplings, U-joints or other means to absorb the displacement of the crankshaft centerline.

SUMMARY OF THE INVENTION

There is provided, in accordance with the present invention, a reciprocating piston internal combustion engine with a varying compression ratio. It comprises a block having at least one piston bore, a piston received in each bore, a head attached to the block and having a dome portion closing the top of each bore and defining with each piston a compression volume when the piston is at top dead center in the bore, a crankcase, a crank rotatably mounted in the crankcase, and a connecting rod coupling each piston to the crank. The block is mounted on the crankcase for pivotal movement about a pivot axis parallel to and spaced apart from the axis of the crank such that the size of the compression volume varies in accordance with the extent of the pivotal movement of the block about the pivot axis. An actuator is connected between the block and the crankcase for pivoting the block about the pivot axis relative to the crankcase in response to at least one signal indicative of at least one operating parameter of the engine.

In a preferred embodiment the pivot axis and the axis of rotation of the crank define a plane that is orthogonal to the axis of each piston bore when the compression volume has a value that is intermediate of the maximum and minimum values, preferably the average of the maximum and minimum values. The axis of each piston bore is offset relative to the crank axis such that there is an equal angular deviation between each bore axis and the corresponding connecting rod at piston top dead center at the minimum and maximum compression volumes on the one hand and at the average of the maximum and minimum compression volumes on the other hand, whereby no angular compensation is required in the position of a camshaft. A camshaft is rotatably mounted on the head portion of the block and is driven by a camshaft drive that includes a drive sprocket on the crank, first and second idler sprockets rotatable about an axis coincident with the pivot axis, a driven sprocket on the camshaft, a first drive belt connecting the drive sprocket to the first idler sprocket, and a second drive belt connecting the second sprocket to the driven sprocket.

The actuator for pivoting the block preferably includes abutments on the block and crankcase, a drive rod, means coupling the drive rod to the abutments for pivotal movement relative to them, means for preloading the coupling means so that the contact stresses between them and the abutments are positive under all load conditions, and means for moving the rod relative to one of the abutments. An engine according to the invention should include a seal between the block and the crankcase, such as a bellows joined by collars to the block and crankcase.

The invention is best suited to provide VCR for in-line, four-stroke SI and CI engines. Engines of opposed or Vee-type construction basically require a pivot center and an actuator for each row of cylinders. Careful design could result in some simplification by combining similar functions of each block, but the greater number of parts will probably result in increased cost for a given power output.

Two-stroke engines, comprising ports in the cylinder wall, will require additional means to ensure the desired opening and closing times of these ports when the C/R is varied.

Radial engines, which are rarely used where load conditions vary frequently, probably cannot economically be adapted to the present type of VCR which, obviously, is not compatible with rotary engines of any type.

An engine embodying the primary characteristic of the invention should provide significantly better fuel economy due to the more efficient combustion at optimal temperatures and pressures over a wide range of operating conditions. Furthermore, due to the mechanical simplicity of providing a pivoting block/head assembly and the well-tried components used for achieving the design objective, an engine embodying the characteristics of the invention should be neither considerably more expensive nor less reliable than a unit of conventional design.

Unlike the CFR design described above, the upper part of the engine of the present invention does not telescope in a straight line but, instead, is adjustable in a circular arc around a center which is fixed with respect to the lower engine structure. The relative position of the engine sections and thus the combustion chamber volume which creates the desired optimal temperature and pressure conditions for the combustion process, is controlled by an actuator attached between points of the lower and upper engine structure, respectively.

The structural advantage of having a common hinge point between the main engine parts becomes apparent when considering the requirement to carry the side loads induced by the angularity of the connecting rod.

A telescoping design, such as the CFR engine, becomes either very heavy when the cylinder walls are moved together with the cylinder head or sealing problems are likely to develop with the combustion products and/or the cooling water when only the head is made adjustable.

A pivoting hinge with zero clearance and a hinge arm which is both light and rigid do not present serious design problems, but the construction of the actuator requires some special attention.

The inertia loads caused by the piston motion are transmitted via the main bearings to the crankcase, but the varying internal cylinder pressures, combined with the friction-drag on the cylinder wall, result in fluctuating, and in some cases reversing, loads on the actuator pivot points. To avoid rapid destruction by this "hammering," the actuator and its hinge points should preferably be preloaded by a spring in the direction of the greater load, i.e., away from the crankcase in the direction which increases the volume of the combustion chamber. To ensure that the contact stresses at the anchor points remain positive, the force exerted by the spring must at all times exceed the opposing force resulting from the negative pressure in the cylinder, the friction component of the piston side thrust on the cylinder wall as well as the friction drag caused by the piston rings.

The extending force of the spring and the positive pressure in the cylinder are counteracted by a single-acting hydraulic cylinder, which through changes in length varies the volume of the combustion chamber. The length of the cylinder is controlled by a three-way valve which lets oil flow into or out of the cylinder when its spool is displaced from the closed center position. The operation of the valve is under control of an electronic unit, triggered by the signal of a knock sensor which reacts to the specific high-frequency vibrations of the combustion chamber wall associated with the onset of detonation in the combustion process.

A flexible seal between the lower edge of the cylinder block and the top of the crankcase prevents dirt from entering the engine and oil from splashing out. The contained pressure is nearly constant and atmospheric and, like the other parts of the VCR mechanism, the seal moves only when the power output of the engine is varied. Under such conditions adequate durability can be obtained much more easily and at a lower cost than in mechanisms such as the BICERA piston in which adjusting movements take place during every revolution or engine cycle.

In an engine embodying a variable compression ratio according to the present invention, the distance between the centers of the crankshaft and the camshaft is not constant and the cam drive requires a design which provides the desired angular relationship between these shafts over the complete range of adjustment. Gear trains, comprising spur gears and/or bevel gears and telescoping shafts are not only costly but troublesome in this respect.

In a preferred embodiment, synchronous belts should be used as the power transmitting medium, but identical results can be obtained when roller- or silent-type chains are used in the proposed geometry.

In order to avoid the cost and complication of moving idlers to absorb pitch length variations of the belts, the drive is divided into two loops of fixed center distance, which connect the double-track idler, journalled concentric with the pivot shaft, with sprockets on the crankshaft and the camshaft, respectively.

For a better understanding of the invention, reference may be made to the following description of an exemplary embodiment, taken in conjunction with the figures of the accompanying drawings.

DESCRIPTION OF AN EXEMPLARY EMBODIMENT

Figure 1:
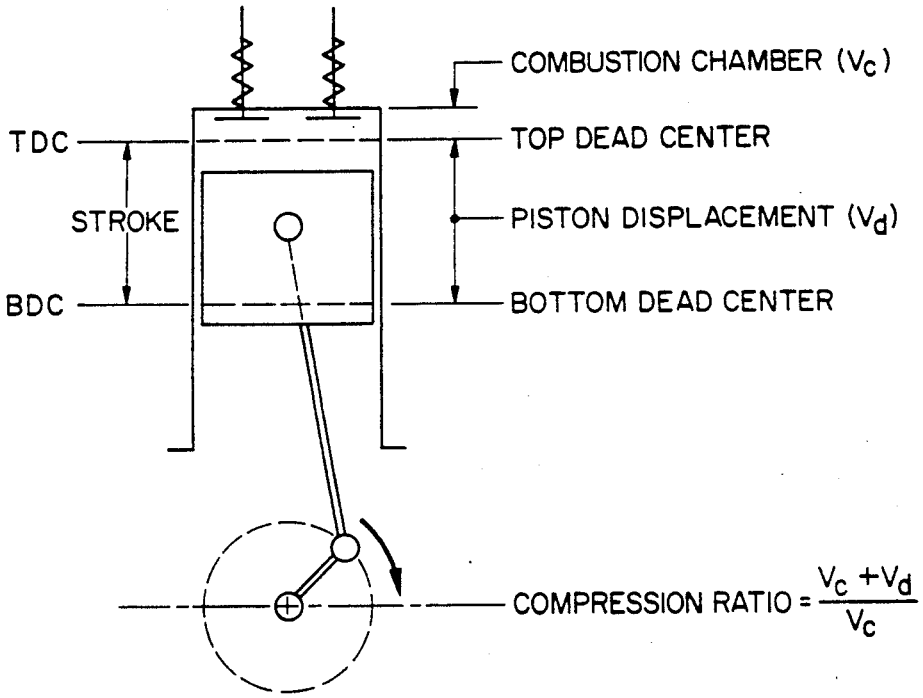
FIG. 1 is a schematic representation of a reciprocating piston engine, illustrating some of the terminology pertaining to the present invention.
Figure 2:
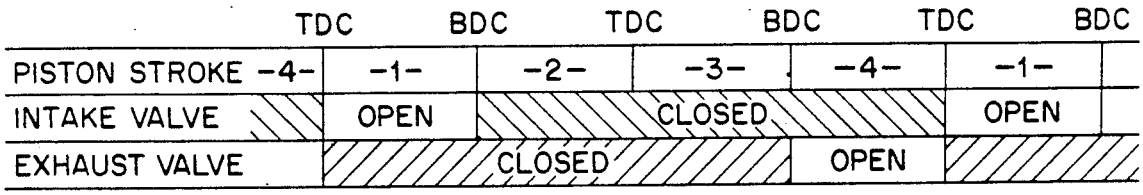
FIG. 2 shows the relationship between the piston and valves in a four-stroke cycle process.
Figure 3C:
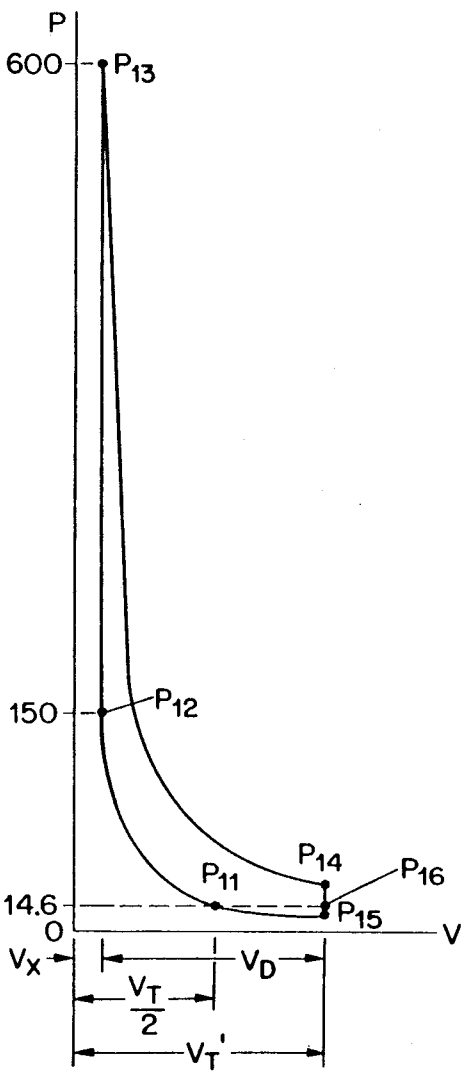
FIG. 3C is an idealized PV diagram of an engine processing a partial cylinder charge in a constant-volume cycle with optimized C/R.
Figure 3B:
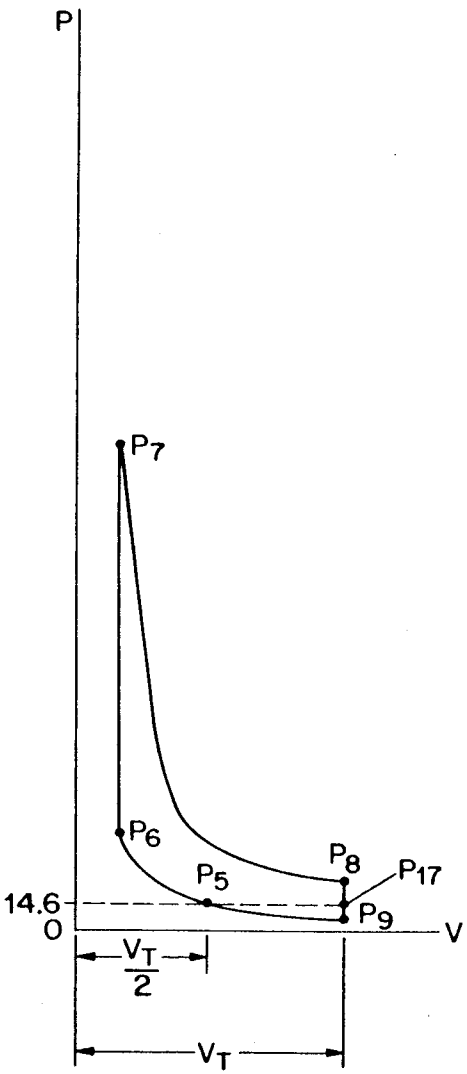
FIG. 3B shows an idealized PV diagram of an engine processing a partial cylinder charge in a constant-volume cycle.
Figure 3A:
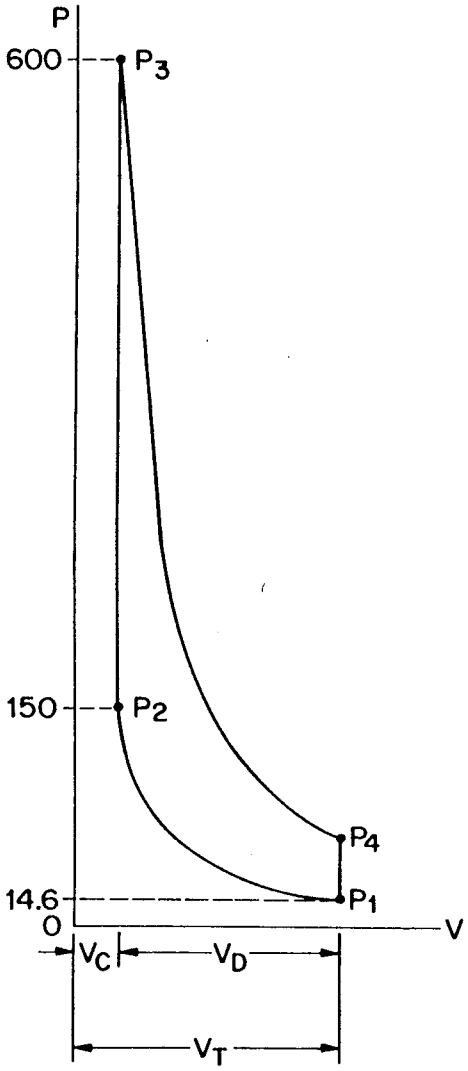
FIG. 3A is an idealized PV diagram of an engine processing the maximum cylinder charge in a constant-volume cycle.

The design illustrated in the accompanying drawings is for a limited production test engine that is intended to be used in demonstrating the effectiveness of a variable compression ratio (VCR) as a means to increase the thermal efficiency of an engine and thus reduce its specific fuel consumption, particularly during part-load operation.

In order to minimize the cost of manufacturing, components that are ordinarily based on castings and forgings in engines designed for production in large numbers have been replaced by welded or oven-brazed assemblies (cylinder head, cylinder block) and built-up construction (crankshaft). Further reduction of manufacturing cost results from the use of off-the-shelf components (valves, piston assembly, sealing bellows).

The engine is built according to standards adopted by most major research institutions and, therefore, does not include a fuel/air mixture preparation system (carburetor or fuel-injection equipment) or the manifolding for gases entering or leaving the cylinder, but is, instead, adaptable to the measuring equipment used to provide pertinent operational data.

To eliminate the influence of parasitic losses associated with engine-driven auxiliary equipment, the engine is designed to be connected to external-loop cooling and lubrication systems, powered by small electric motors.

Since the nature of VCR testing does not involve the interaction between adjacent cylinders and the manifolding that connects them, the test engine is built as a single-cylinder unit. This configuration has the additional advantage of keeping down the cost and time required to make structural changes to major components such as heads, piston and valve gear, as indicated by test results.

High-speed operation of a single-cylinder engine of the preferred size ordinarily requires either an extremely heavy or a spring-mounted dynamometer platform to cope with the inertia forces generated by this construction.

As a preferred but optional feature, the engine is equipped with an oscillating counterweight, connected to the three-throw crankshaft by two connecting rods. These rods, which are of the same nominal length as the main connecting rod between the piston and the crankshaft, are at one end rigidly connected to the counterweight. The other end is supported by a needle bearing on the crankthrow journal. The center of the counterweight contains a self-aligning sleeve bearing, the bore of which is an accurate sliding fit on the outer surface of a guide bar, aligned with the cylinder axis and rigidly attached to the engine structure. Moving 180° out-of-phase with the piston, the mass of the counterweight and the amplitude of the oscillating motion are chosen to exactly balance both the first and second order shaking forces caused by the piston motion without the creation of a rocking couple which is usually found in engines of the opposed piston type.

The engine incorporates all of the features described in the Summary of the Invention section above. Thus, while operating on a conventional four-stroke cycle, the volume of the compression space can be reduced during part-load operation; the pressure and temperature of the combustion process are thereby maintained at values which in conventional engines only prevail during maximum power output.

The volume variation of the compression space is made possible by constructing the engine in two assemblies, the block/head and the crankcase, which are joined in an articulatory manner by a pivot pin located alongside and parallel with the crankshaft axis.

The distance between the pivot axis and the crankshaft is not critical but it should be made as short as practical, in order to minimize the overall width of the engine.

The preferred geometry, which minimizes the angles of articulation $\alpha$ and $\beta$ between the block and crankcase and thus maximizes the durability of the seal between these assemblies, results when the cylinder axis, while the block is in the mid position of the compression ratio adjustment range, is perpendicular to the plane defined by the axes of the crankshaft and the engine articulation joint.

FIGS. 9, 10, 11, 12A and 12B of the drawings show further geometric relationship underlying the design of the engine.

Figure 9:
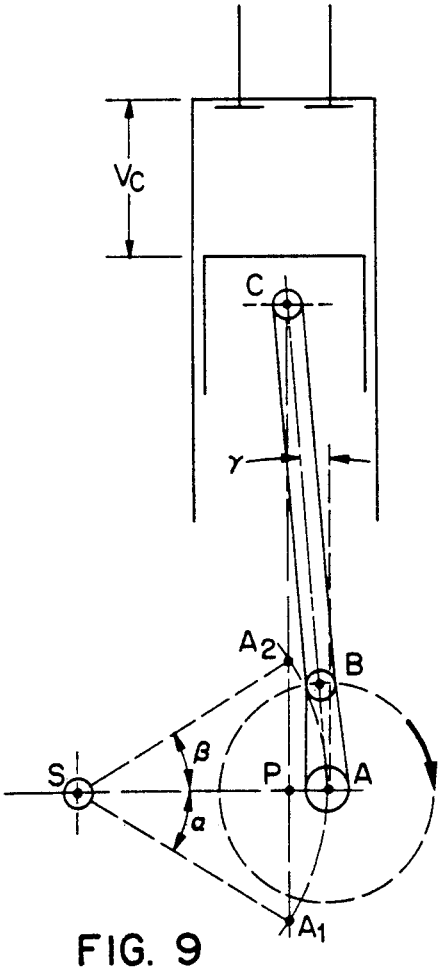
FIG. 9 is a schematic representation of a kinematic inversion of the engine shown in FIGS. 4 to 8.

FIG. 9 is a schematic of the engine which shows more clearly the geometric relationship between the tilt angle $\alpha$ and $\beta$, and the TDC-position of the crankshaft $\gamma$, by using the principle of kinematic inversion, whereby the cylinder block is fixed and the crankshaft axis is displaceable through a circular arc.

Figure 10:
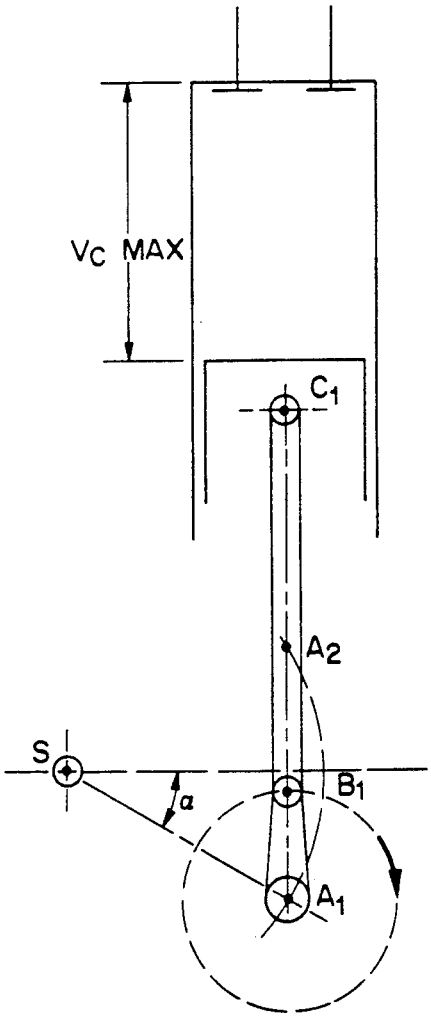
FIG. 10 is a schematic representation of the engine of FIGS. 4 to 8 shown in the maximum power output position.
Figure 11:
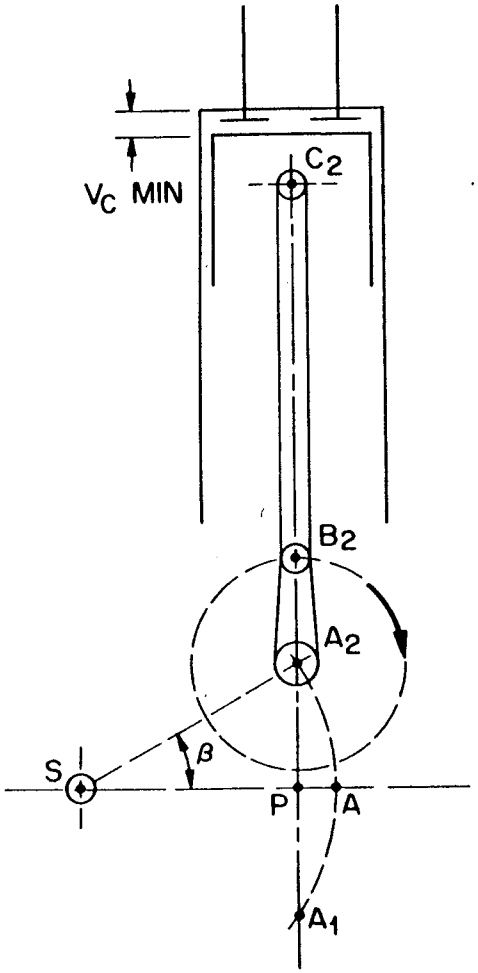
FIG. 11 is a schematic representation of the engine shown in the minimum power output position.

The limiting positions of the adjustment range are shown in FIGS. 10 and 11.

Figure 12B:
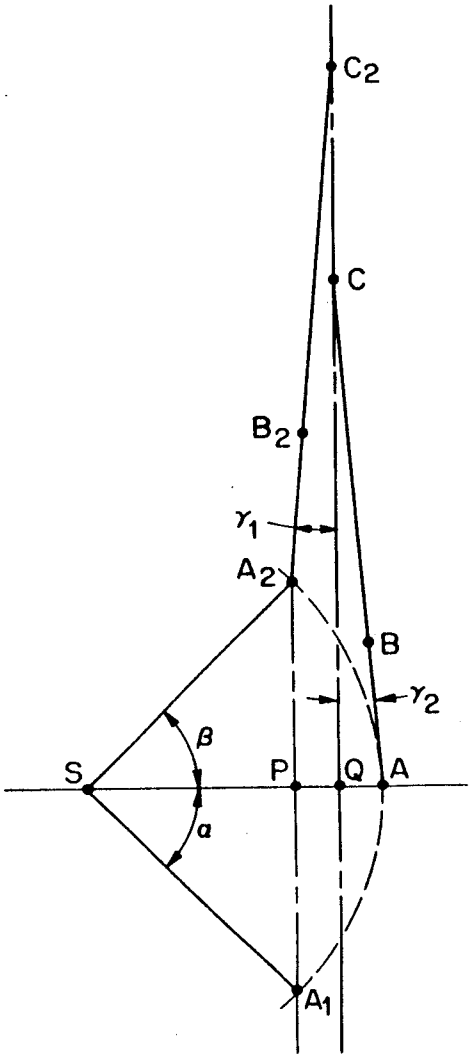
FIG. 12B shows the effect of engine offset on the variation in TDC-position of the crankshaft.
Figure 12A:
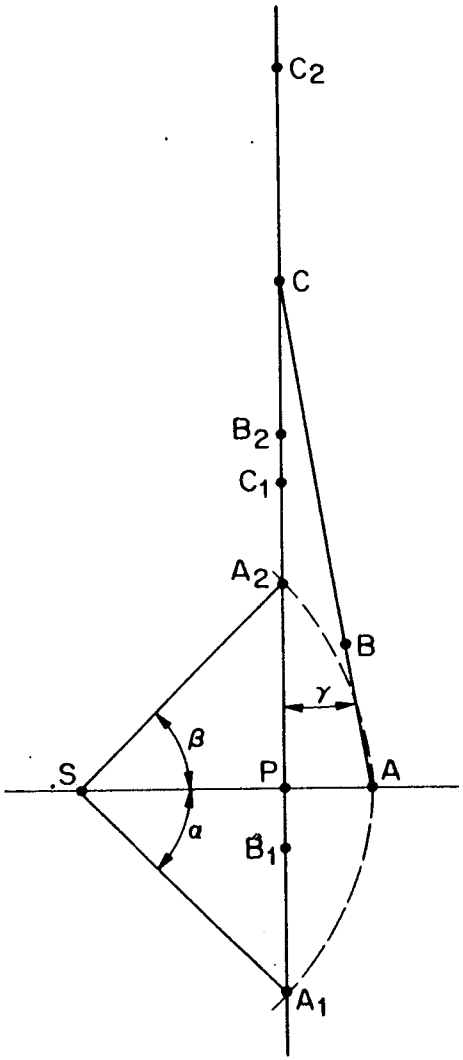
FIG. 12A shows the angular variation in the TDC-position of the crankshaft.

The diagram of FIG. 12A is used to calculate practical values of $\alpha$, $\beta$ and $\gamma$, after assumptions, based on proportions common in modern conventional engine design are made, and expressing all pertinent dimensions as multiples of the crank radius.

| | |
|---|---|
| Crank radius: | $AB = 1$ |
| Stroke: | $V_D = 2(AB) = 2$ |
| Conn Rod Length: | $BC = 3.3$ |
| Swing Radius: | $SA = SA_1 = SA_2 = 2.8$ |
| C/R (Min.): | $= 1 + V_D/V_C\text{Max.})$ |
| $V_C$ Max.: | $= V_D/6 = 2/6 = .33$ |
| K: | $= V_C\text{ Max.}/V_C\text{ Min.} = 4.7$ |
| $V_C$ Min.: | $= [.33/4.7 = .07$ |

$C/R\ (\text{Max.}) = 1 + (V_D/V_C\ \text{Min.})$
$= 1 + 2/.07 = 29.6$
$C_2C_1 = V_C\ \text{Max.} - V_C\ \text{Min.}$
$= .33 - .07$
$= .26$
$A_1A2 = C_1C_2 = .26$
LET: $\alpha = \beta$
$A_2P = PA_1 = A_1A_2/2 = .13$
$\alpha = \sin^{-1}(A_1P/SA_1)$
$= \sin^{-1}(.13/2.8)$
$\alpha = 2.66°$ AND $\beta = 2.66°$
$PA = SA_2(1 - \cos\alpha) = 2.8(.0011)$
$PA = .003$
$\gamma = \sin^{-1}[PA/(AB + BC)]$
$= .003/(1 + 3.3)$
$\gamma = .04°$ FIG. 12B shows that $\gamma$ can be further reduced by offsetting the cylinder axis a distance $PQ = PA/2 = 0.0015$ $$\gamma_1 = \gamma_2 = \sin^{-1}(0.0015/4.3) = 0.02 \text{ degrees}$$

A deviation of $\pm 0.02$ degrees from the true position of the crankshaft TDC has no significant influence on the engine performance and in a practical design no angular compensation is thus required in the position of the camshaft(s) when the crankshaft axis is adjusted through the full range of C/R variation.

Figure 14:
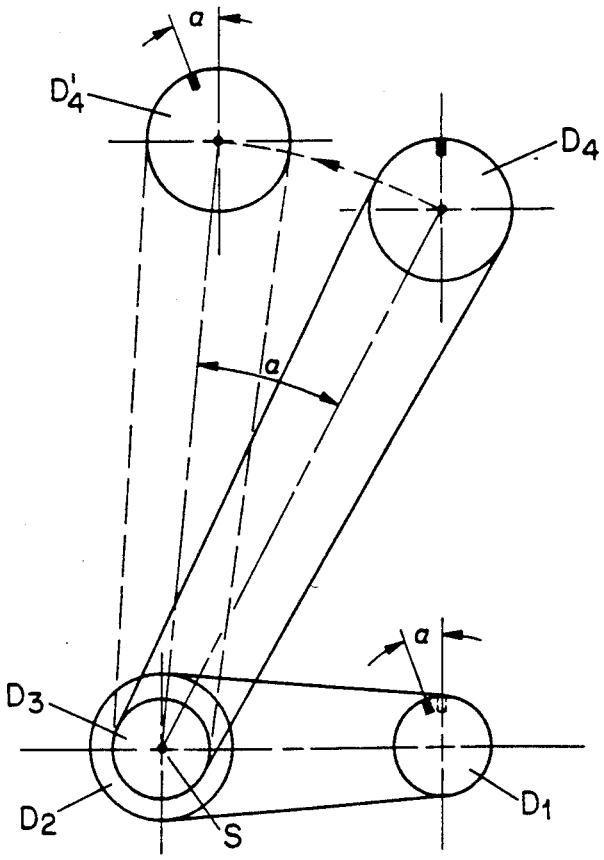
FIG. 14 shows schematically the camshaft drive of a preferred embodiment of the engine.

The camshaft drive, which is schematically represented in FIG. 14 of the drawings, and is described and completely analyzed below, meets the engine design requirements.

The engine is a single-cylinder, four-stroke model of 4 inch bore and 3.48 inch stroke, displacing 44 cubic inch. The output of the engine is estimated to be 25 HP @ 3600 RPM.

Figure 4:
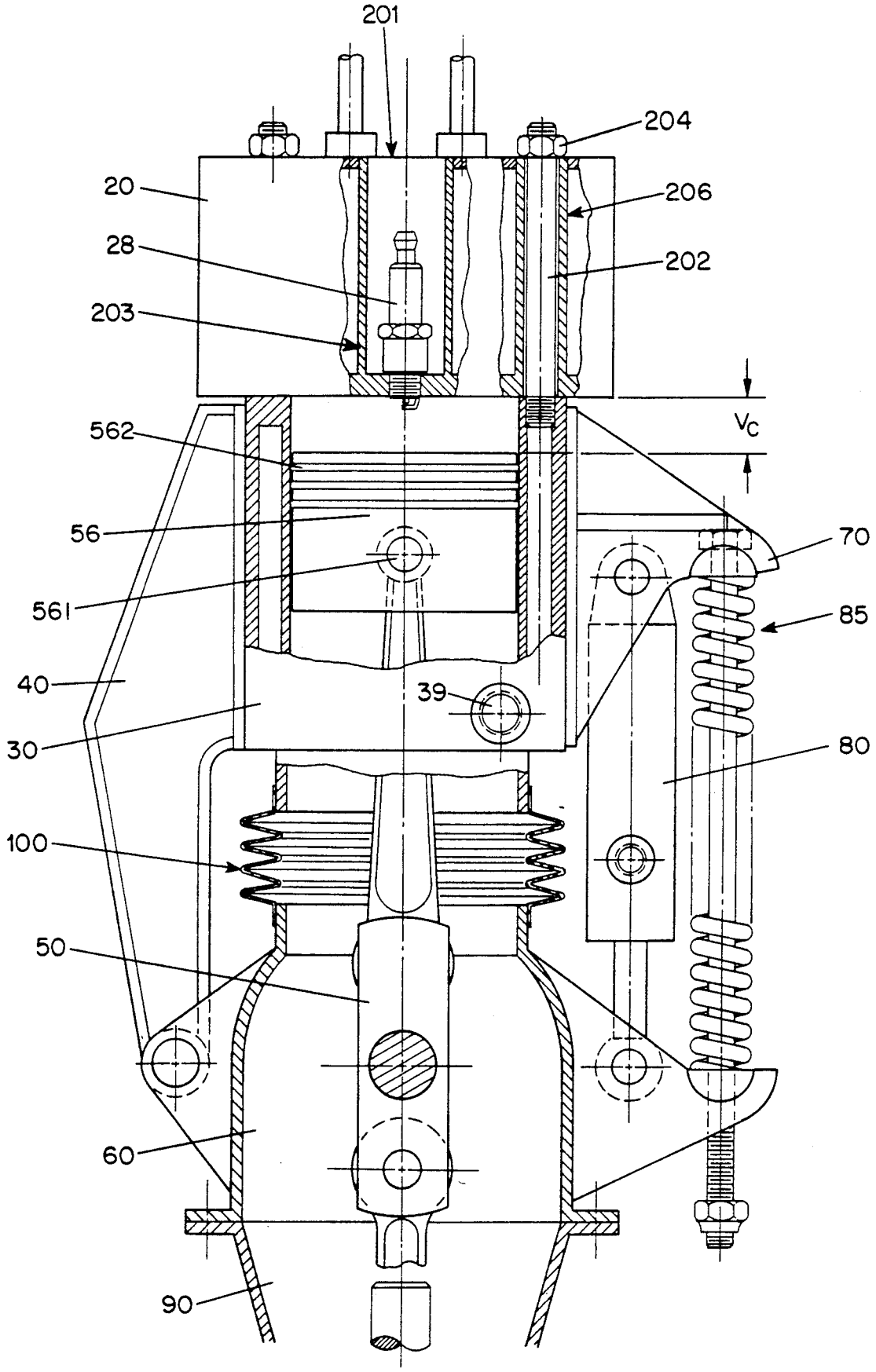
FIG. 4 is a cross-sectional view of a single-cylinder engine embodying the present invention.
Figure 5:
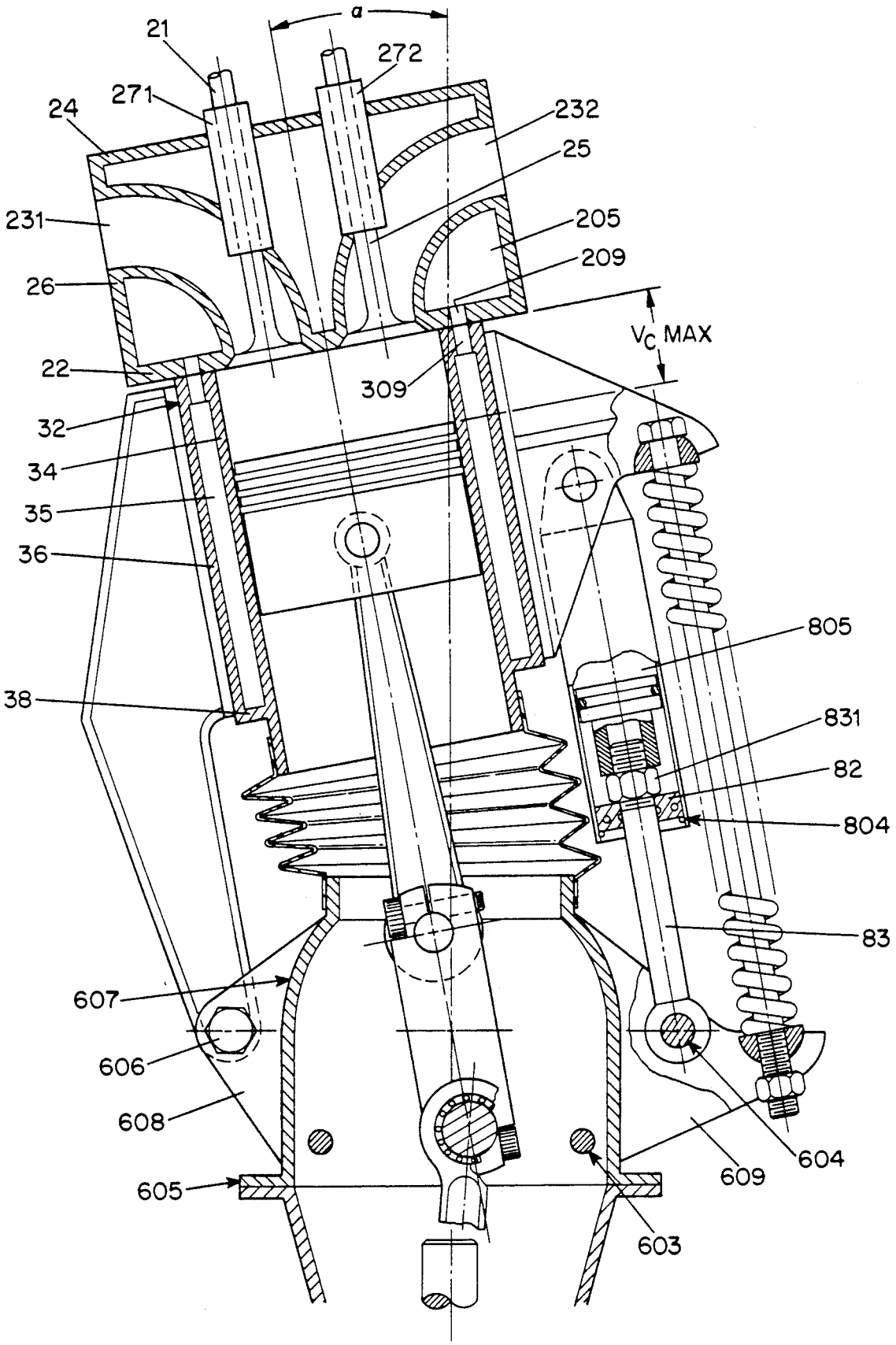
FIG. 5 shows the engine of FIG. 4 with the actuator fully extended and the combustion chamber increased to the maximum size.
Figure 6:
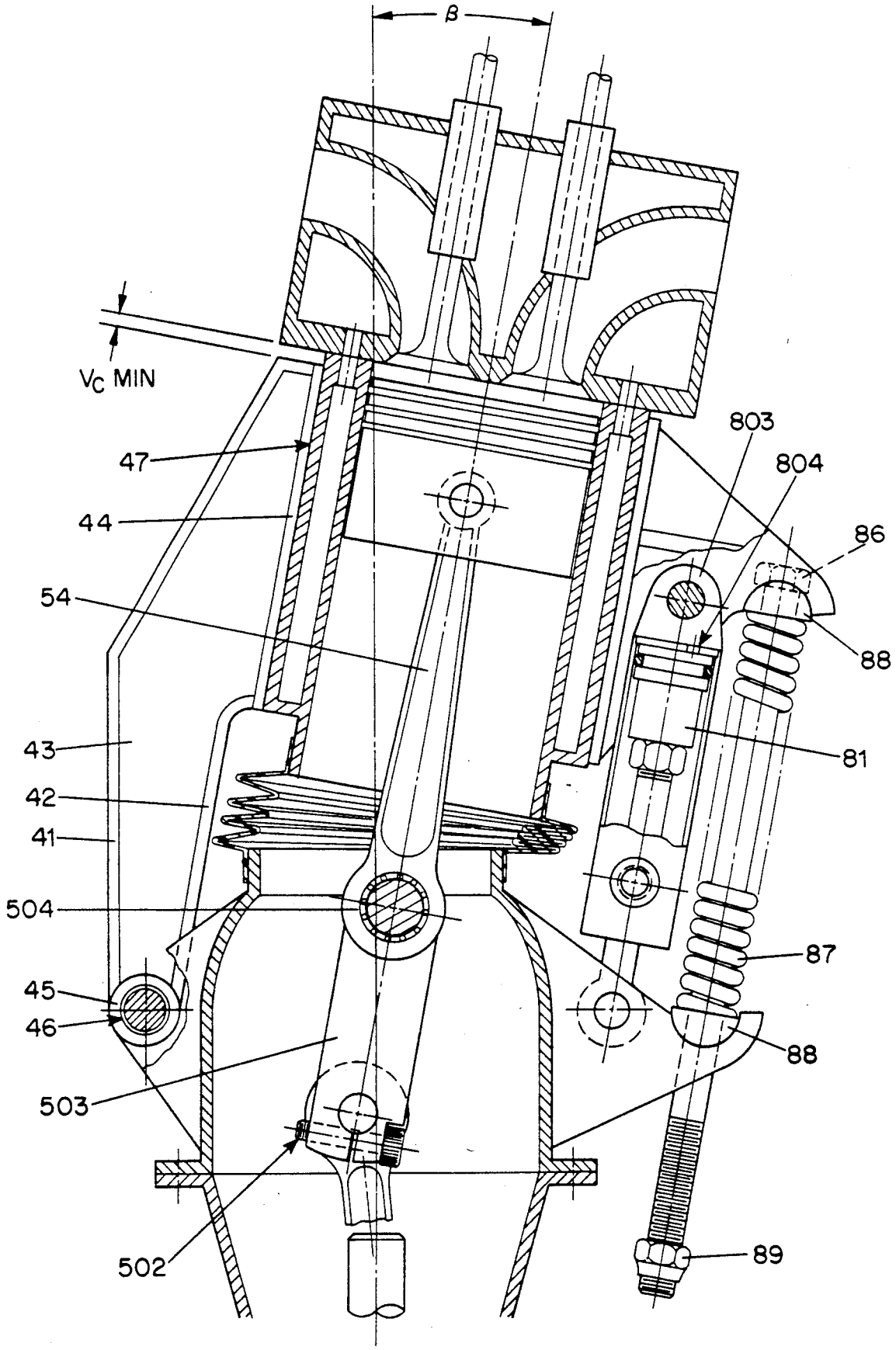
FIG. 6 shows the engine of FIG. 4 with the actuator fully retracted and the combustion chamber reduced to the minimum size.

Referring now to FIGS. 4 to 8 of the drawings, the cylinder head, which is designated generally by the reference numeral 20, is a rectangular box defined by a base wall 22, an end wall 24 and a perimeter or side wall 26 (see FIG. 5). From the perimeter, passages 231 and 232 lead to openings in the base wall 22, sealed by the intake valve(s) 21 and exhaust valve(s) 25. Valve guides 271, 272, supported by the end wall 24 and the walls of the ducts 231, 232, provide a sliding seal around the valve stems and maintain concentricity between the valves and the valve seats in the base wall. A sealing tube 203 (FIG. 4) extends from the end wall 24 to the upper surface of the base wall 22. Its open end 201 provides access to a spark plug 28, which is threaded into the base wall. The cylinder head assembly 20 is attached to the cylinder block assembly 30 through studs 202 threaded into the plate 32, and receiving nuts 204. Tubes 206 welded between the top plate 24 and base plate 22 create a watertight enclosure for these fasteners.

Coolant enters the interior 205 of the cylinder head 20 through a port 29 (FIG. 7) in the side wall 26 and flows from the head to the cylinder jacket 35 through registering holes 209, 309 in the base wall 22 and the block (FIG. 5). It leaves the cylinder jacket through the port 39 (FIG. 7), and after passing through a heat exchanger is returned, by an external circulation pump, to the engine at the port 29.

The valve gear is generally designated by a rectangular box and shown as reference numeral 10 in the drawings, but because it is a "state-of-the-art" mechanism comprising one or more camshafts operating spring-loaded valves in the conventional manner providing valve opening characteristics of constant lift and non-adjustable duration and timing, it is not shown in detail or described herein.

As a preferred but optional aspect of the engine, the valve gear may have variable opening timing and/or duration, either automatic or under control of the operator, to vary the engine power output without incurring the pumping losses associated with the conventional power output control by means of a throttle valve in the inlet duct.

The cylinder block 30 consists of an inner cylinder 34, a perimeter wall 36, a top plate 32 and a base plate 38. The cylinder 34 is preferably made of cast iron to provide a long-wearing surface for the piston 56 and the piston rings 562. The lower part of the cylinder tube 34 protrudes beyond the base plate 38 to form a cylindrical collar on which a flexible bellows seal 100 is clamped. The seal 100 forms a dust and oil tight connection between the cylinder block 30 and the crankcase 60, which enables the variation in the engine configuration, required for the adjustment from $V_C$ min. to $V_C$ max., and a commercially available, off-the-shelf, single-convolution rubber bellows possessing adequate flexibility to withstand the necessary range of deformation ($\pm 2°40'$) indefinitely may be used. It is available with cuff-type extensions which form a sealed connection with the collar 607 and the end of tube 34 when the clamps 102 (FIG. 7) are tightened. It should be noted that the angles of adjustment $\alpha$ and $\beta$ in the interest of clarity have been grossly exaggerated wherever shown in the drawings.

The single plane, three-throw crankshaft, which is generally designated by reference numeral 50, consists of (see FIGS. 6 and 8) a crankpin 501, clamped by screws 502 of webs 503 to end shaft assemblies 51 carrying a flywheel 52 and a cam drive sprocket 53. Each end shaft is a brazed assembly comprising a shaft 511, a web 512 and a short crankpin 513.

The main connecting rod 54 is pivotably carried on the crankpin 501 by a needle bearing 504. It is at the upper end pivotably connected by a piston pin 561 to the piston 56, which carries piston rings 562.

Crankpins 513 pivotably support on needle bearings 551 the upper ends of auxiliary connecting rods 55, the lower ends of which are rigidly connected to the balancing weight 57 which includes a self-aligning guide bearing 571, located by retaining rings 572.

Oil seals 58 protect the bearings 59 that support the crankshaft assembly in the crankcase.

An upper crankcase, which is generally designated by reference numeral 60, consists of fabricated symmetrical front and rear sections 601, 602, joined by staybolts 603 and fasteners 604 and 606 coinciding with the pivot pins for a linear actuator 80 and a hinge arm 40, located in a horizontal plane through the crankshaft axis. The upper edge 607 forms a cylindrical collar adaptable to the cuff of the flexible bellows seal 100; the lower edge 605 is a bolting flange for joining with the lower crankcase assembly 90. Welded to the sides of the upper crankcase are mounting pivots 608, 609, for the hinge arm 40 and the linear actuator 80 and a preload spring assembly 85.

The lower crankcase assembly 90 is a welded box shaped like a four-sided truncated pyramid with a flanged open top. Trapezoidal-shaped front and rear plates 91 and rectangular side plates 92 are joined at the lower end by a bottom plate 93 which is machined for rigid and accurate attachment of a balance weight guide bar 94. The upper flange 95 is bolted to the lower flange 605 of the upper crankcase 60 forming a rigid and oil-tight connection which is dowelled to assure perfect alignment of the guide bar 94 with the plane defined by the cylinder axis while travelling through an arc of alpha degrees plus beta degrees when the engine is adjusted between $V_C$ max. and $V_C$ min.

Oil for lubrication, which is supplied by an external pump driven by a small electric motor, enters the engine near the top of the valve gear housing 10.

Details of the lubrication system are omitted from the drawings, inasmuch as it is well within the ability of one with ordinary skill in the art to design them appropriately.

A pair of flexible external drain lines connect the sump of the valve gear housing with ports in the upper crankcase where the oil enters the space between the oil seal 58 and the single-sealed crankshaft bearing 59, lubricating the latter. Static pressure, due to the elevation of the valve gear sump above the crankshaft center line, forces the oil through a cross-drilled hole in the end shaft 51 located between the area overrun by the seal 58 and the seat of the bearing 59, into a passage drilled longitudinally through the center of this shaft, leading to a radially drilled passage in the outer web 512.

Crankpins 501 and 513 are of similar configuration, each having a passage drilled longitudinally through the center and a pair of radially drilled supply or discharge holes centered in both hub sections. Twice as wide, pin 501 has two, instead of one, bearing lubricating holes connecting the center passage with the surface of the bearing race. The angles between the planes of the supply holes and the lubricating holes differ in both crankpins and in the assembled crankshaft the lubricating holes in pin 501 are located farther from the center of the crankshaft than those of pins 513. As a result, the centrifugal force acting upon the oil in the rotating crankshaft creates a difference in static pressure between these lubricating holes and causes an oil flow, whereby half of the oil reaching pin 513 lubricates bearing 551 and the remainder is bypassed into the radial passage through inner web 503 to lubricate one-half of the main connecting rod bearing 504.

Oil leaking from the bearings 551 and 504, after splash-lubricating the inside wall of the tube 34, piston pin 561 and balance weight guide bar 94, collects in the bottom of the lower crankcase 90 and is removed by an external scavenging pump connected to drain port 96.

The part that maintains the intended rigid geometric relationship between the cylinder block and the crankcase is the hinge arm assembly 40. A front plate 41 and a rear plate 42 are welded to side plates 43 to form a tube of varying rectangular cross section. A mounting plate 44 closes off the upper opening of the tube, while a heavy-wall cylindrical tube 45 is welded to the lower end forming the housing for the pivot pin bearings 46. Shimstock 47 is placed between mounting plate 44 and the cylinder block 30 to adjust the offset of the block and the corresponding angle $\gamma$ (see FIG. 12).

On the side of the cylinder block, opposite the hinge arm, four threaded holes and fasteners 701 are provided for mounting an actuator bracket generally designated as reference numeral 70, which consists of the four-hole mounting plate 71, welded to the side plate 72 and reinforcing gussets 73. The apices of plates 72 are shaped to form half-circular hooks 722 that facilitate the installation of the preload spring assembly 85.

The linear actuator 80 is a single-acting hydraulic cylinder which receives oil under pressure at an inlet port 801 attached to a cylinder tube 802. An end cap 803, with bleedhole 804 to permit air flow into and out of a cylinder space 805 above the piston 81, is welded to the top of the tube 802 and pivotably connected to the actuator bracket 70. The open end of the cylinder is closed by a rod seal carrier 82, secured in the cylinder tube by a retaining ring 804. The lower end of a piston rod 83 is pivotably attached to the upper crankcase by means of the pin 604, and the upper end is threaded into the piston 81 and secured by a locknut 831.

The maximum extended and minimum retracted lengths of the cylinder 80, whereby the piston 81 abuts either the end cap 803 or the rod seal carrier 82, are chosen to control the total travel of the cylinder block assembly between the $V_C$ maximum and $V_C$ minimum positions.

The preload spring assembly 85 consists of a long, partly-threaded bolt 86, a compression spring 87 which abuts against the flat surfaces of the semi-circular pivot pins 88 and a self-locking retaining nut 89.

The above-described arrangement of the preload spring assembly represents an optional but preferred embodiment, since it enables the following procedure for safely installing a spring which carries the required 400 lbs. preload:

(1) Fully extend cylinder 80 to place the engine in the $V_C$ maximum position.

(2) Tighten nut 89 to compress the spring 87 until the distance between pins 88 is shortened, enabling insertion between the upper and lower hooks.

(3) Back off nut 89, completely unloading bolt 86, transferring the spring load to the actuator.

Figure 8:
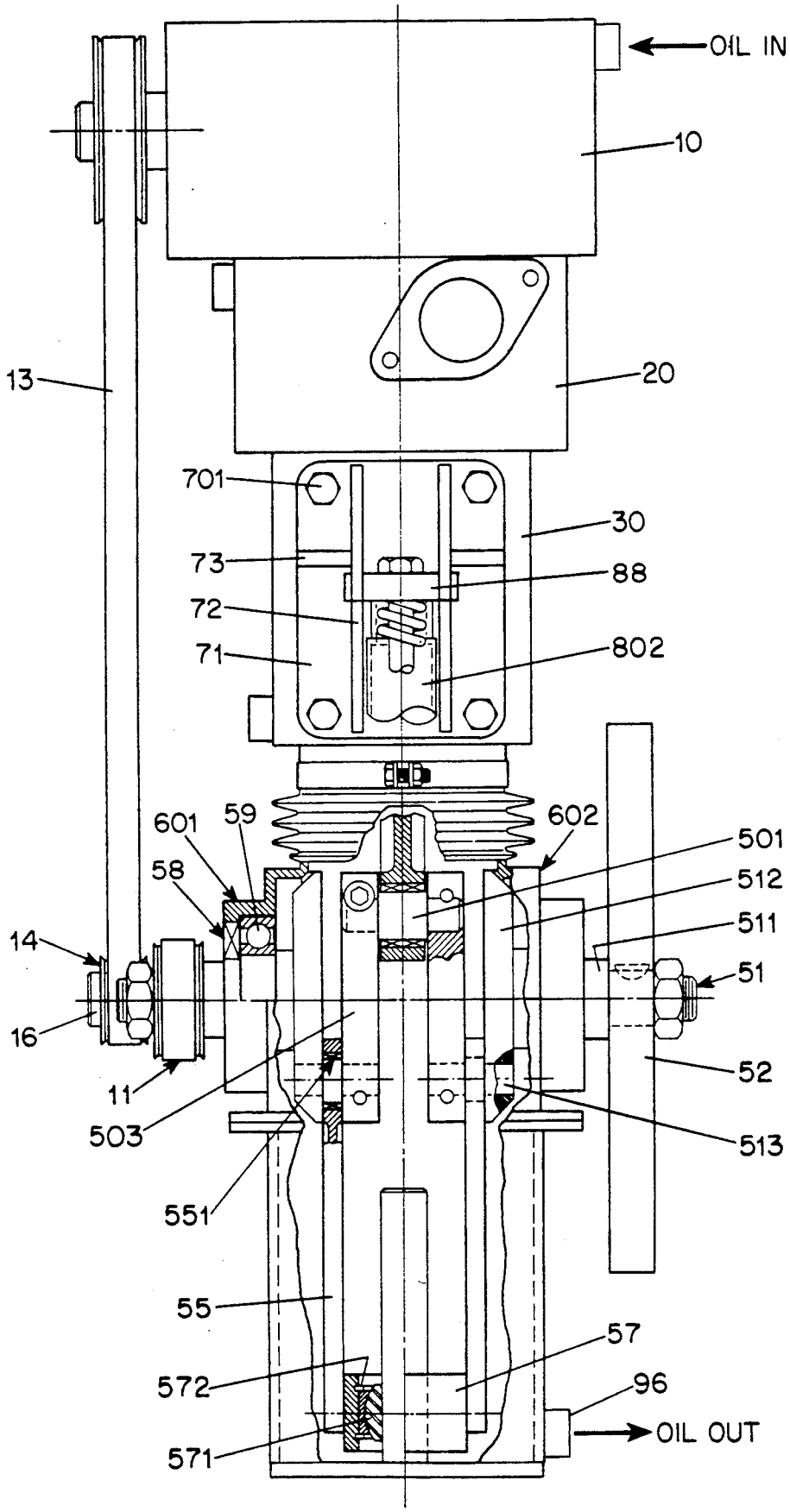
FIG. 8 shows a part side-elevational and a part side cross-sectional view of the engine of FIGS. 4 to 7.
Figure 3D:
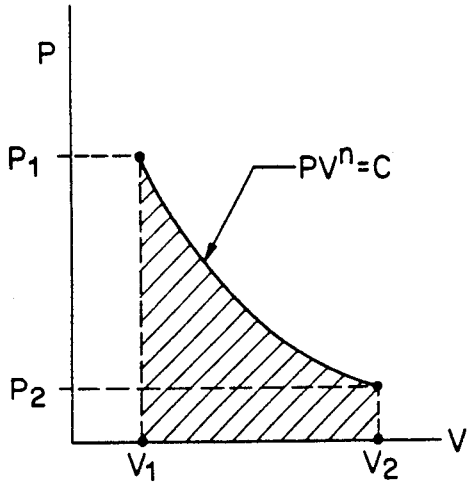
FIG. 3D is a diagram depicting the calculations of the work done by the gases on a piston in a four-stroke cycle IC engine.

The cam drive, which is shown in FIGS. 8 and 9 of the drawings and schematically represented in FIG. 14, consists of a first belt loop 11 which connects the crankshaft-mounted sprocket 53 with a sprocket 12 of equal pitch diameter. A second belt loop 13 connects the sprocket 14 with a sprocket 15 mounted on the camshaft.

The pitch diameter of the sprocket 15 is twice the pitch diameter of the sprocket 14 in order to drive the camshaft at one-half the speed of the crankshaft, as required in an engine operating on the four-stroke cycle.

The sprockets 12 and 14 are joined together and in a preferred configuration, when the pitch diameters are made equal, form a double-width sprocket which is free-spinning on an extension 16 of the pivot pin 606 and concentric therewith.

When the cylinder block is rotated $\alpha°$ from the mean position to the $V_c$ max. position (see FIGS. 4 and 5), the camshaft must not rotate, and the drive sprocket, therefore, must retain its angular position with respect to the block and head assembly while rotating $\alpha°$ with respect to the pivot center The TDC position of the crankshaft is shifted $\alpha°$ also with respect to the initial position. [The very small influence of angle $\gamma$ is neglected (FIGS. 12A and 12B.)]

The rotation of the camshaft sprocket is composed of two inputs:

(1) Motion in a circular arc $\alpha°$ while restrained by a belt loop which includes a sprocket concentric with the center of rotation.

(2) The rotation of the crankshaft $\alpha°$, multiplied by the transmission ratio of the belt drive.

The following analysis of the first motion input (see FIG. 13) will show that when two sprockets $D_{fixed}$ and $D_{orbiting}$ with pitch diameters $D_F$ and $D_o$, respectively, are connected by a taut belt loop and $D_o$ moves in a circular arc with radius R around the center of $D_F$, the resulting relative motion of $D_o$ with respect to $D_F$ is composed of a translation, whereby the distance between any point on $D_o$ to the center of rotation remains constant, and a superimposed rotation $\delta$.

Figure 13:
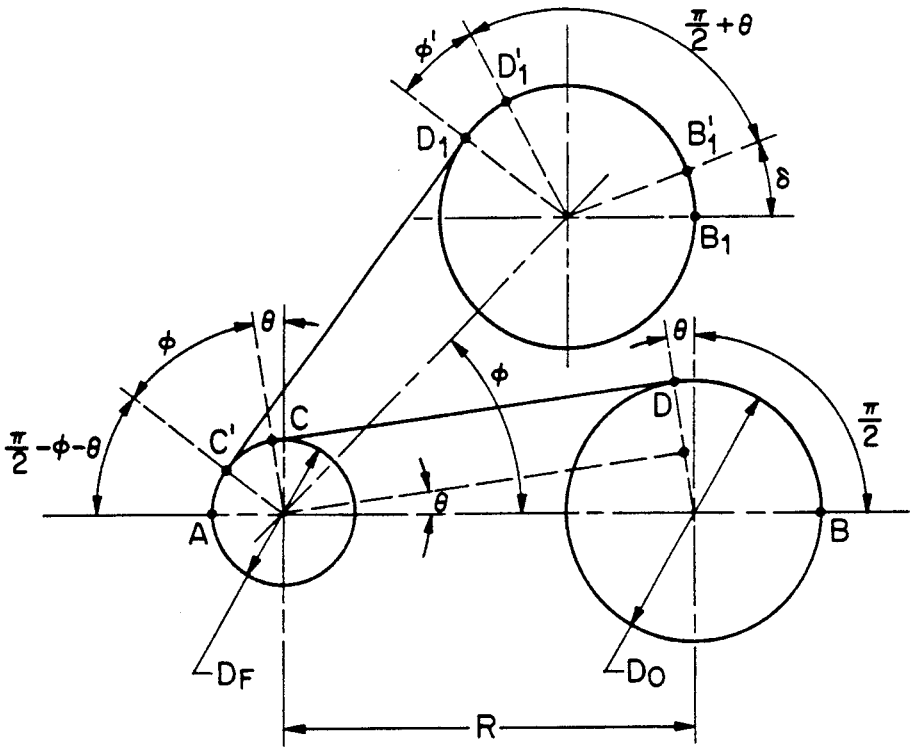
FIG. 13 illustrates the rotation of a sprocket orbiting a stationary sprocket while both sprockets are constrained by an encircling belt loop.

In FIG. 13:

$$D_F/D_o = k$$

$$\sin^{-1}\theta = (D_o - D_F)/2R$$

$$CD = C'D_1 = R\cos\theta$$

$$C'C = D_1D_1'$$

$$(D_F/2)\phi = (D_o/2)\phi'$$

$$\phi' = (D_F/D_o)\phi$$

$$\phi' = k\phi$$

$$D_1'B_1' = DB = \pi/2 + \theta$$

$$\delta = \pi - (\pi/2 - \phi - \theta) - \phi' + \pi/2 + \theta)$$

$$\delta = \pi - \pi/2 + \phi + \theta - k\phi - \pi/2 - \theta$$

$$\delta = (1-k)\phi$$

A positive value of $\delta$ designates a rotation of $D_o$ in the same sense as the swinging motion.

Figure 7:
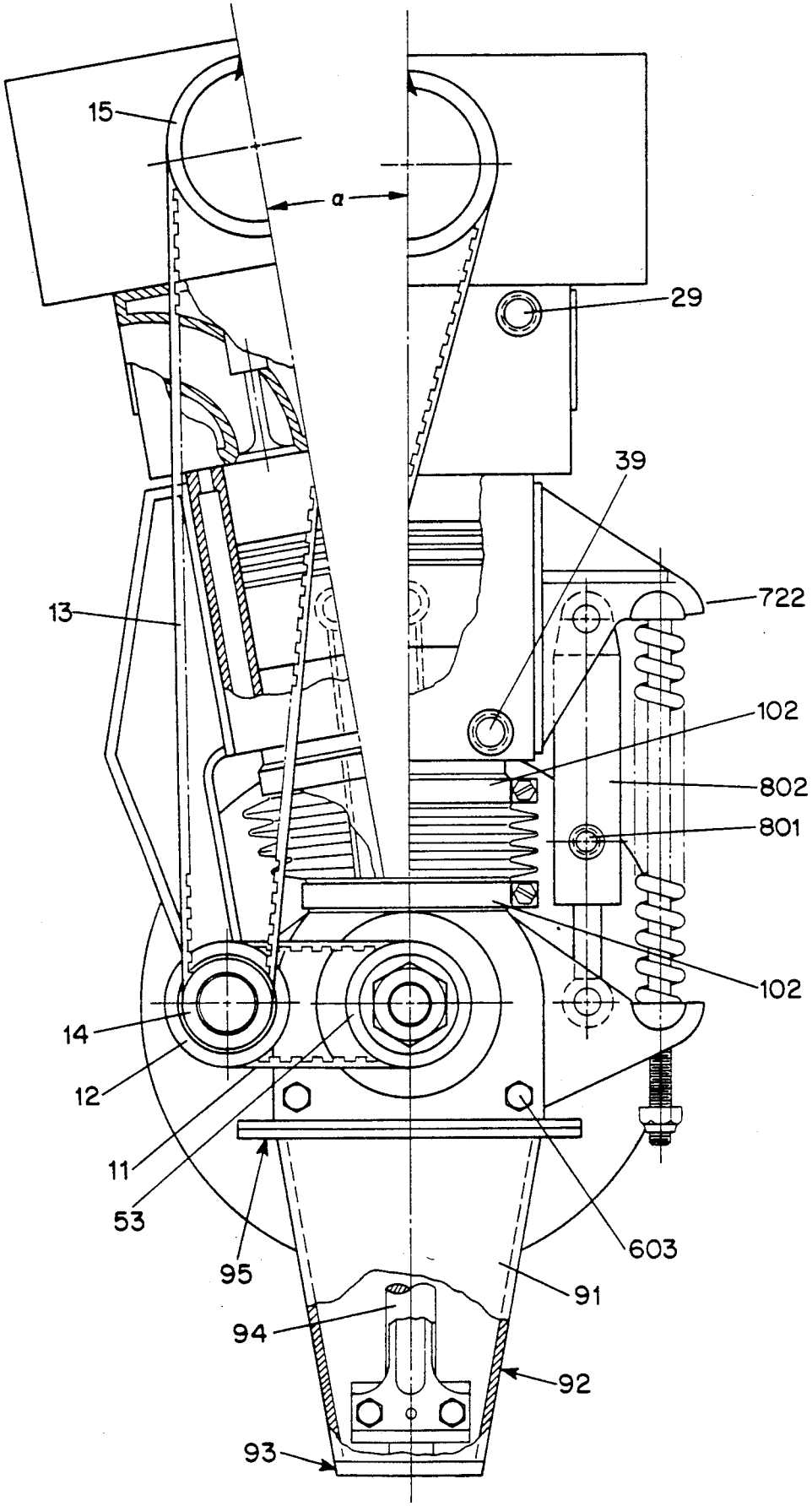
FIG. 7 is a split front elevational view of the embodiment of FIGS. 4 to 6.

Referring now to FIGS. 7 and 8 of the drawings, which show the camshaft drive of the preferred embodiment, and to the schematic of this drive, FIG. 14:

$D_1$ (sprocket 53) is connected to the crankshaft, $D_2D_3$ (sprockets 12 and 14) depicts the two-track idler concentric with the axis of articulation and $D_4$ (sprocket 15) is connected to the camshaft or to the input shaft of an optional reduction cam drive unit with a ratio $k_3$.

$D_1/D_2=k$ and $D_3/D_4=k_2$

When $D_1$ is rotated $\alpha°$, the resulting rotation of $$D_4,\alpha'=(k_1k_2)\alpha.$$

Swinging $D_4$ through an arc $\alpha°$ results in a rotation of $$D_4,\alpha''=(1-k_2)\alpha \text{ (see FIG. 13).}$$

From the basic requirement, as shown in FIG. 4:

$$\alpha'+\alpha''=\alpha$$

$$(k_1k_2)\alpha+(1-k_2)\alpha=\alpha$$

$$(k_1k_2)+(1-k_2)=1$$

For $k_2$ unequal to zero $$k_2=k_1k_2$$

$$k_1=1$$

This leads to the following conclusions:

(1) The first stage belt drive must comprise equal size sprockets 53 and 12, i.e., $D_1=D_2$;

(2) $k_2$ or $k_3$ can be assigned any practical value, but in order to drive the camshaft at the correct speed when the engine operates on a four-stroke cycle, $k_2k_3=2$ and where $D_4$ is connected directly to the camshaft, $k_3=1$ and $k_2=2$.

A further aspect of an engine which embodies a variable compression ratio in accordance with the present invention is the higher average temperature at the beginning of the expansion stroke, which increases the heat rejection rate to the surrounding walls. Since the total amount of heat rejected to the cooling system and in the exhaust products is reduced, in accordance with the claimed increase in thermal efficiency during part-load operation of the engine, it follows that the heat rejection rate toward the end of the expansion stroke must be lower than in conventional engines.

In order to cope with this condition, in a preferred embodiment of the invention, the coolant enters the engine in the region of the highest wall temperatures, i.e., the cylinder head, flows along the cylinder walls and is returned to the radiator from the cylinder block at a point where the prevailing wall temperatures are lowest (see FIG. 7).

The above-described reversing of the direction of the coolant flow, in comparison with common engine design practice, increases the temperature difference across the walls of the cylinder head and thus increases the local heat absorbing capacity without increasing the coolant flow rate, which would lead to overcooling of the lower cylinder walls and loss of thermal efficiency.

The concept of variable compression ratio in accordance with the present invention is not limited to single-cylinder engines but is adaptable to in-line engines of any number of cylinders, in particular, to passenger car engines which operate under part-load conditions during a significant portion of their running time. The following summary of the scope and extent of redesign required to modify existing engine design and adapt the proposed VCR system indicates that, although significant, the cost of a redesign should not be so great as to render it impractical in view of the potential improvement in fuel economy.

The cylinder block and head can be carried over virtually unaltered when an engine design is modified and adapted for the method of VCR described by the present invention. Pads to attach the hinge arm and the upper pivot of the actuator must be added and the lower end of the cylinders shaped to accommodate the cuff or flange of the bellows-type flexible seal. In a conventional engine, the crankcase will lose most of the rigidity necessary to provide for the proper alignment of the crankshaft bearings when it is separated from the cylinder block. A local redesign is, therefore, essential, and provisions have to be made for structurally-sound supports for the hinge and actuator mounting points as well as attachments for the sealing bellows.

The crankcase of an engine built in accordance with the present invention will be attached to the vehicle by means of vibration-absorbing mountings that allow some movement of the engine with respect to the surrounding structure, predominantly in a plane perpendicular to the crankshaft axis. The angular displacement of the cylinder block (less than about 3°) to accomplish VCR is superimposed on the motions of the crankcase, but it is expected that the existing connections between the engine and the structure-mounted components such as the cooling system, fuel and air supply and output controls, can provide the additional flexibility without a major redesign.

Finally, the separation of cylinder block and crankcase may make the reintroduction of integral cylinder heads a practical approach to a simplified construction which should lead to lower cost and reduced weight.

The embodiment described above and shown in the drawings is exemplary, and numerous variations and modifications will be readily apparent to those of ordinary skill in the art. For example, the single-acting hydraulic cylinder controlling the variation in the engine compression ratio can be replaced with an all-mechanical system, comprising a screw-jack and a nut powered by a small electric motor under control of the electronic switch unit mentioned above. The preload spring can, in that case, advantageously be installed concentric with the screw-jack, resulting in a simplified construction.

I claim:

1. A reciprocating piston engine with a varying compression ratio comprising a block having at least one piston bore, a piston received in each bore, a head attached to the block and having a dome portion closing the top of each bore and defining with the piston a compression volume when the piston is at top dead center in the bore, a crankcase, a crank rotatably mounted in the crankcase, a connecting rod coupling each piston to the crank, means for mounting the block on the crankcase for pivotal movement about a pivot axis parallel to and spaced apart from the axis of the crank such that the size of the compression volume varies in accordance with the extent of the pivotal movement of the block about the pivot axis, and actuator means connected between the block and the crankcase for pivoting the block about the pivot axis relative to the crankcase in response to at least one signal indicative of at least one operating parameter of the engine.

2. An engine according to claim 1 wherein the pivot axis and the axis of rotation of the crank define a plane that is orthogonal to the axis of each piston bore when the compression volume has a value that is intermediate of the maximum and minimum values.

3. An engine according to claim 1 wherein the pivot axis and the axis of rotation of the crank define a plane that is orthogonal to the axis of each piston bore when the compression volume has a value that is the average of the maximum and minimum values.

4. An engine according to claim 3 wherein the axis of each piston bore is offset relative to the crank axis such that there is an equal angular deviation between each bore axis and the corresponding connecting rod at piston top dead center at the minimum and maximum compression volumes on the one hand and at the average of the maximum and minimum compression volumes on the other hand, whereby no angular compensation is required in the position of a camshaft.

5. An engine according to claim 4 and further comprising a camshaft rotatably mounted on the head portion of the block and camshaft drive means including a drive sprocket on the crank, first and second idler sprockets rotatable about an axis coincident with the pivot axis, a driven sprocket on the camshaft, a first drive belt connecting the drive sprocket to the first idler sprocket, and a second drive belt connecting the second sprocket to the driven sprocket.

6. An engine according to claim 1 wherein the actuator means includes abutments on the block and crankcase, a drive rod, means coupling the drive rod the abutments for pivotal movement relative to them, means for preloading the coupling means so that the contact stresses between them and the abutments are positive under all load conditions, and means for moving the rod relative to one of the abutments.

7. An engine according to claim 1 and further comprising sealing means between the block and the crankcase.

8. An engine according to claim 7 wherein the sealing means is a bellows joined by collars to the block and crankcase.

9. An engine according to claim 1 when the head has a head coolant chamber having a coolant inlet and the block has a block coolant chamber having a coolant outlet, and further comprising means for conducting a coolant into the head coolant chamber through the inlet and removing coolant from the block coolant chamber through the outlet.

* * * * *

US005025757A

REEXAMINATION CERTIFICATE (1829th)

United States Patent [19]

Larsen

[11] B1 5,025,757

[45] Certificate Issued Oct. 27, 1992

[54] RECIPROCATING PISTON ENGINE WITH A VARYING COMPRESSION RATIO

[76] Inventor: Gregory J. Larsen, 4501 Hallman Hill La., Lakeland, Fla. 33813

Reexamination Request:
No. 90/002,624, Jan. 27, 1992

Reexamination Certificate for:

| | |
|---|---|
| Patent No.: | 5,025,757 |
| Issued: | Jun. 25, 1991 |
| Appl. No.: | 582,410 |
| Filed: | Sep. 13, 1990 |

[51] Int. Cl.[5] ..... F02B 75/04
[52] U.S. Cl. ..... 123/48 R; 123/78 R
[58] Field of Search ..... 123/48 R, 78 R

[56] References Cited

U.S. PATENT DOCUMENTS

| | | | |
|---|---|---|---|
| 1,219,781 | 3/1917 | Salisbury | 123/48 C |
| 1,343,536 | 6/1920 | Weeks | 123/48 R |
| 2,770,224 | 11/1956 | Ericson | 123/48 C |
| 3,633,552 | 1/1972 | Huber | 123/48 R |
| 3,868,931 | 3/1975 | Dutry et al. | 123/78 R |
| 4,419,969 | 12/1983 | Bundrick, Jr. | 123/48 R |
| 4,876,992 | 10/1989 | Sobotowski | 123/48 R |

FOREIGN PATENT DOCUMENTS 3542629 6/1987 Fed. Rep. of Germany .

*Primary Examiner*—David A. Okonsky

[57] ABSTRACT

A reciprocating piston internal combustion engine with a varying compression ratio comprises a block having at least one piston bore, a piston received in each bore, a head attached to the block and having a dome portion closing the top of each bore and defining with the piston a compression volume when the piston is at top dead center in the bore, a crankcase, a crank rotatably mounted in the crankcase, and a connecting rod coupling each piston to the crank. The block is mounted on the crankcase for pivotal movement about a pivot axis parallel to and spaced apart from the axis of the crank such that the size of the compression volume varies in accordance with the extent of the pivotal movement of the block about the pivot axis. An actuator connected between the block and the crankcase pivots the block about the pivot axis relative to the crankcase in response to at least one signal indicative of at least one operating parameter of the engine.

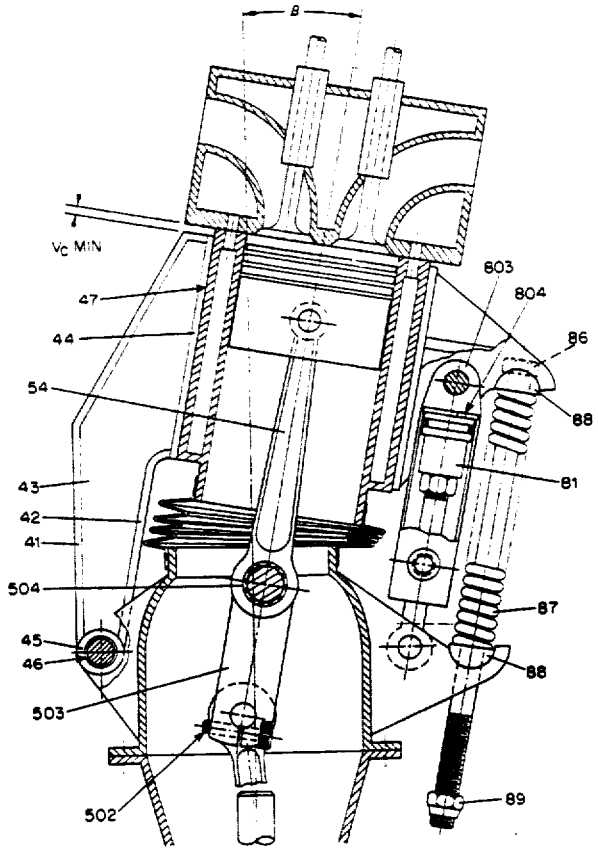

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 2 is cancelled.

Claim 1 is determined to be patentable as amended.

Claims 3-9, dependent on an amended claim, are determined to be patentable.

1. A reciprocating piston engine with a varying compression ratio comprising a block having at least one piston bore, a piston received in each bore, a head attached to the block and having a dome portion closing the top of each bore and defining with the piston a compression volume when the piston is at top dead center in the bore, a crankcase, a crank rotatably mounted in the crankcase, a connecting rod coupling each piston to the crank, means for mounting the block on the crankcase for pivotal movement about a pivot axis parallel to and spaced apart from the axis of the crank such that the size of the compression volume varies in accordance with the extent of the pivotal movement of the block about the pivot axis, *the pivot axis and the axis of rotation of the crank defining a plane that is orthogonal to the axis of each piston bore when the compression volume has a value that is intermediate of the maximum and minimum values* and actuator means connected between the block and the crankcase for pivoting the block about the pivot axis relative to the crankcase in response to at least one signal indicative of at least one operating parameter of the engine.

* * * * *